US006390901B1

(12) United States Patent
Hiyama et al.

(10) Patent No.: US 6,390,901 B1
(45) Date of Patent: May 21, 2002

(54) POLISHING APPARATUS

(75) Inventors: Hirokuni Hiyama, Tokyo; Yutaka Wada; Kazuto Hirokawa, both of Chigasaki; Hisanori Matsuo, Fujisawa; Tetsuji Togawa, Chigasaki; Satoshi Wakabayashi, Yokohama, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/397,916

(22) Filed: Sep. 17, 1999

(30) Foreign Application Priority Data

Sep. 18, 1998 (JP) ..... 10-265160

(51) Int. Cl.[7] ..... B24B 29/00

(52) U.S. Cl. ..... 451/285; 451/287; 451/288; 451/41

(58) Field of Search ..... 451/288, 285, 451/287, 41, 236, 289

(56) References Cited

U.S. PATENT DOCUMENTS 3,866,361 A * 2/1975 Mauck ..... 451/285
4,319,432 A * 3/1982 Day ..... 451/288
5,584,750 A * 12/1996 Ishida et al. ..... 451/288
5,647,792 A * 7/1997 Katsuoka et al. ..... 451/285
5,704,827 A * 1/1998 Nishi et al. ..... 451/285
5,921,852 A 7/1999 Kimura et al.
6,066,562 A * 5/2000 Ohshima et al. ..... 451/446
6,116,994 A * 9/2000 Ito et al. ..... 451/288

* cited by examiner

*Primary Examiner*—Joseph J. Hail, III
*Assistant Examiner*—Lee Wilson
(74) *Attorney, Agent, or Firm*—Wenderoth, Lind & Ponack, L.L.P.

(57) ABSTRACT

An object of the present invention is to provide a polishing apparatus with a grinding plate that can easily and reliably be installed on and detached from a turntable. The polishing apparatus has a grinding plate tool, fixedly mounted on the turntable, which includes the grinding plate, and a top ring for holding a workpiece to be polished and pressing the workpiece against the grinding plate in sliding contact therewith for polishing a surface of the workpiece to a flat, mirror finish. A clamping mechanism is mounted in the turntable for fixing an outer circumferential flange of the grinding plate tool to the turntable.

7 Claims, 9 Drawing Sheets

POLISHING APPARATUS

BACKGROUND OF THE INVENTION

1. Field of the Invention

The present invention relates to a polishing apparatus for polishing a workpiece such as a semiconductor wafer or the like with a grinding plate to a flat, mirror finish, and more particularly to a polishing apparatus with a mechanism for installing a grinding plate easily and reliably on a turntable.

2. Description of the Related Art

Recent rapid progress in semiconductor device integration demands smaller and smaller device and wiring patterns or interconnections and also narrower spaces between interconnections which connect active areas. One of the processes available for forming such interconnections is photolithography. Though the photolithographic process can form interconnections that are at most 0.5 μm wide, it requires that surfaces on which pattern images are to be focused by a stepper be as flat as possible because the depth of focus of the optical system is relatively small. It is therefore necessary to make the surfaces of semiconductor wafers flat for photolithography. One customary way of flattening the surface of semiconductor wafers on which integrated circuit devices are formed has been to polish semiconductor wafers with polishing a apparatus.

Heretofore, polishing apparatus for polishing planar workpieces, generally referred to as CMP (Chemical Mechanical Polishing) apparatus, comprise a turntable with a polishing pad attached thereto and a top ring for holding a planar workpiece to be polished. The top ring which holds a workpiece to be polished presses the workpiece against the polishing pad on the turntable. While an abrasive liquid is being supplied to the polishing pad, the top ring and the turntable are rotated about their own axes to polish the lower surface of the workpiece to a planar mirror finish. In particular, the planar workpiece to be polished is a device wafer with a circuit pattern formed thereon.

FIG. 1 of the accompanying drawings shows a conventional polishing apparatus. As shown in FIG. 1, the conventional polishing apparatus comprises a turntable 5 with a polishing pad 6 attached to an upper surface thereof, a top ring 1 for holding a semiconductor wafer 4 which is a workpiece to be polished while rotating and pressing the semiconductor wafer 4 against the polishing pad 6, and an abrasive liquid supply nozzle 9 for supplying an abrasive liquid Q to the polishing pad 6. The top ring 1 is connected to a top ring drive shaft 8, and supports on its lower surface a resilient mat 2 such as of polyurethane or the like. The semiconductor wafer 4 is held on the top ring 1 in contact with the resilient mat 2. The top ring 1 also has a cylindrical guide ring 3 mounted on a lower outer circumferential surface thereof and having a lower end projecting downwardly beyond the lower supporting surface of the top ring 1 for preventing the semiconductor wafer 4 from being dislodged from the lower surface of the top ring 1 while the semiconductor wafer 4 is being polished. The top ring 1 is tiltably supported on the lower end of the top ring drive shaft 8 by a ball bearing In operation, the semiconductor wafer 4 is held against the lower surface of the resilient mat 2 on the top ring 1, and pressed against the polishing pad 6 by the top ring 1. The turntable 5 and the top ring 1 are rotated about their own axes to move the polishing pad 6 and the semiconductor wafer 4 relatively to each other in sliding contact for thereby polishing the semiconductor wafer 4. At this time, the abrasive liquid Q is supplied from the abrasive liquid supply nozzle 9 to the polishing pad 6. The abrasive liquid Q comprises, for example, an alkaline solution with fine abrasive grain particles of silica or the like suspended therein. Therefore, the semiconductor wafer 4 is polished by both a chemical action of the alkaline solution and a mechanical action of the fine abrasive grain particles. Such a polishing process is referred to as a CMP process.

The conventional CMP process in which the abrasive slurry of fine abrasive grain particles is supplied to the polishing pad suffers the following two problems.

The first problem is that the polished surface may not be fully planarized and may have undulations depending on the types of patterns and the states of steps on the polished surface. Generally, patterns on semiconductor wafers have various dimensions and steps. Some of the steps include smaller convexities and concavities spaced at a pitch of a few μm and having heights ranging from 0.5 to 1 μm, and larger convexities and concavities spaced at a pitch ranging from 100 μm to 1 mm. When the surface of such a semiconductor wafer with those steps, which is covered with a film of silicon dioxide or aluminum, is planarized, both convexities and concavities of the pattern are polished such that the polishing rate is higher in regions where smaller convexities and concavities are present and lower in regions where larger convexities and concavities are present. As a result, large undulations are developed on the polished surface. The reason for such large undulations is that since the surface of the semiconductor wafer is chemically and mechanically polished by the relatively soft polishing pad of polyurethane or the like and the abrasive liquid, not only the convexities but also the concavities of the surface are polished.

The second problem is that the polishing apparatus incurs a high running cost and needs special care to avoid environmental contamination. The abrasive liquid comprises an alkaline solution with fine abrasive grain particles of silica or the like suspended therein, for example. In order to polish the semiconductor wafer to a highly uniform planar finish, the abrasive liquid needs to be supplied in a sufficient quantity onto the polishing pad. However, most of the supplied abrasive liquid does not contribute to the actual polishing operation, but is discharged as a waste liquid. Because the abrasive liquid used in polishing highly dense semiconductor wafers is highly costly, it makes the polishing process also highly costly. Furthermore, since the abrasive liquid is in the form of a slurry containing fine abrasive grain particles of silica or the like, its waste liquid requires special attention to keep the working environment clean. Specifically, a system for supplying the abrasive liquid and a system for discharging the waste liquid tend to be greatly contaminated, and a system for processing the waste liquid is highly complicated.

There is known a process of polishing semiconductor wafers with a grinding plate. The grinding plate, which is also referred to as a fixed abrasive polisher, comprises a flat plate of abrasive grain particles of silica or the like which are coupled together by a binder. The grinding plate is applied to a turntable, and a semiconductor wafer held by a top ring is pressed against the grinding plate and polished thereby in sliding movement relative thereto.

Since the grinding plate is harder than the polishing pad, only convexities on the surface of the semiconductor are polished, and the polished surface is free of any appreciable undulations and is sharply defined. As no slurry containing fine abrasive grain particles is used, the cost of the polishing process is lower, and any special care to avoid environmental contamination is not necessary.

A polishing apparatus which employs the grinding plate requires that the grinding plate and the turntable be fixed to each other easily and reliably.

A conventional polishing pad is attached to a turntable by an adhesive applied to the reverse surface of the polishing pad. The polishing pad is bonded to the turntable continuously from an end of the turntable while being elastically deformed in order not to trap air bubbles in the bonded surface. The bonded polishing pad can be peeled off from an end of the turntable while being elastically deformed.

A grinding plate, however, cannot be elastically deformed when it is installed on and detached from a turntable because the grinding plate is much more rigid than the polishing pad. Therefore, the grinding plate cannot directly be bonded to and peeled off the turntable with ease and efficiency.

The polishing pad is usually bonded to the turntable by preparing a polishing pad blank larger in diameter than the turntable, bonding the polishing pad blank to the turntable, and then cutting off any excessive end portion of the polishing pad blank to leave a polishing pad, of the same diameter is as the turntable, bonded to the turntable. This bonding process is employed because, if a polishing pad of the same diameter as the turntable were initially bonded to the turntable, then the efficiency would be poor because the desired positional accuracy of the polishing pad with respect to the turntable would not easily be achieved. The grinding plate cannot be installed on the turntable according to the above process since the grinding plate, which is much harder than the polishing pad, cannot easily be cut off and cannot be handled efficiently on site. Accordingly, the grinding plate needs to be fixed to the turntable with high positional accuracy and efficiency according to a process other than the conventional bonding process.

SUMMARY OF THE INVENTION

It is therefore an object of the present invention to provide a polishing apparatus with a grinding plate that can easily and reliably be installed on and detached from a turntable.

According to an aspect of the present invention, there is provided a polishing apparatus comprising a turntable, a grinding plate tool fixedly mounted on the turntable and including a grinding plate, holding means for holding a workpiece to be polished and pressing the workpiece against the grinding plate in sliding contact therewith for polishing a surface of the workpiece to a flat, mirror finish, and a clamping mechanism for fixing an outer circumferential portion of the grinding plate tool to the turntable.

According to another aspect of the present invention, there is provided a polishing apparatus comprising a turntable, a grinding plate tool fixedly mounted on the turntable and including a grinding plate, and holding means for holding a workpiece to be polished and pressing the workpiece against the grinding plate in sliding contact therewith for polishing a surface of the workpiece to a flat, mirror finish, the turntable having a plurality of interconnected holes defined therein for developing a vacuum between the grinding plate and the turntable to attract the grinding plate fixedly to the turntable.

According to still another aspect of the present invention, there is provided a polishing apparatus comprising a turntable, a grinding plate tool fixedly mounted on the turntable and including a grinding plate, the grinding plate tool being made of a magnetic material, holding means for holding a workpiece to be polished and pressing the workpiece against the grinding plate in sliding contact therewith for polishing a surface of the workpiece to a flat, mirror finish, and a magnet disposed in the turntable for magnetically attracting the grinding plate tool fixedly to the turntable.

According to yet another aspect of the present invention, there is provided a polishing apparatus comprising a turntable, a grinding plate tool fixedly mounted on the turntable and including a grinding plate, holding means for holding a workpiece to be polished and pressing the workpiece against the grinding plate in sliding contact therewith for polishing a surface of the workpiece to a flat, mirror finish, and a stopper pin disposed between the grinding plate tool and the turntable and fixing the grinding plate tool to the turntable.

Since the grinding plate is fixed to the turntable by any of the various members, the grinding plate can easily and reliably be installed on and detached from the turntable. The polishing machine with the grinding plate can be operated highly efficiently. The grinding plate can polish the workpiece to a sharply defined finish at a reduced cost without the need for special care to avoid environmental contamination.

Since the grinding plate can easily and reliably be replaced with a new one, the lead time in a polishing process carried out by the polishing apparatus can be reduced. Because the grinding plate can be selected and replaced as desired to meet the properties of the workpiece to be polished, it is possible to use a wide variety of grinding plates of various polishing characteristics to satisfy various polishing needs. As a result, various workpieces can be polished in an optimal fashion matching the properties thereof.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 2A:
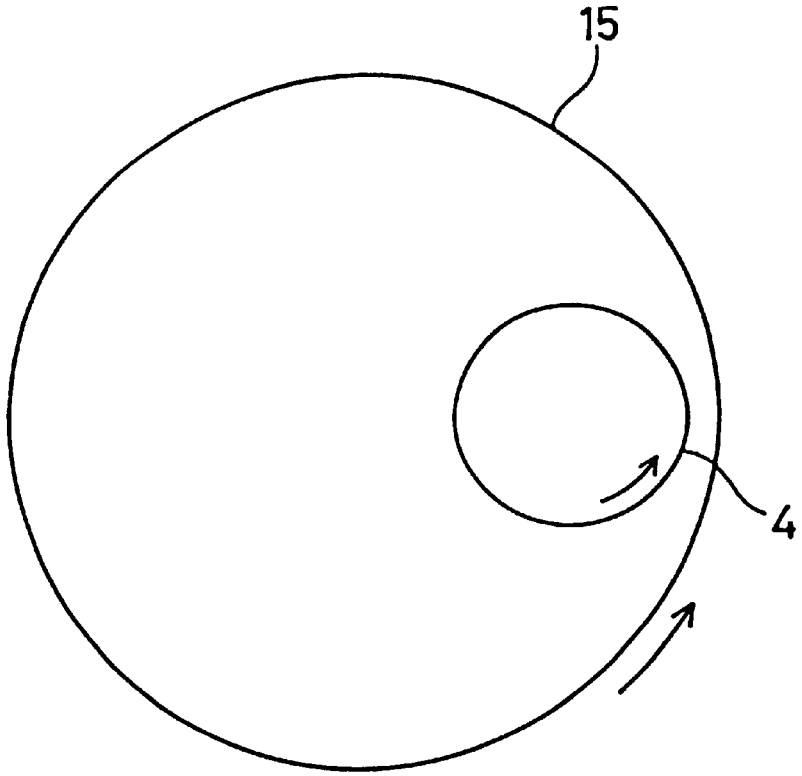
FIG. 2A is a plan view of a polishing apparatus according to the present invention.
Figure 2B:
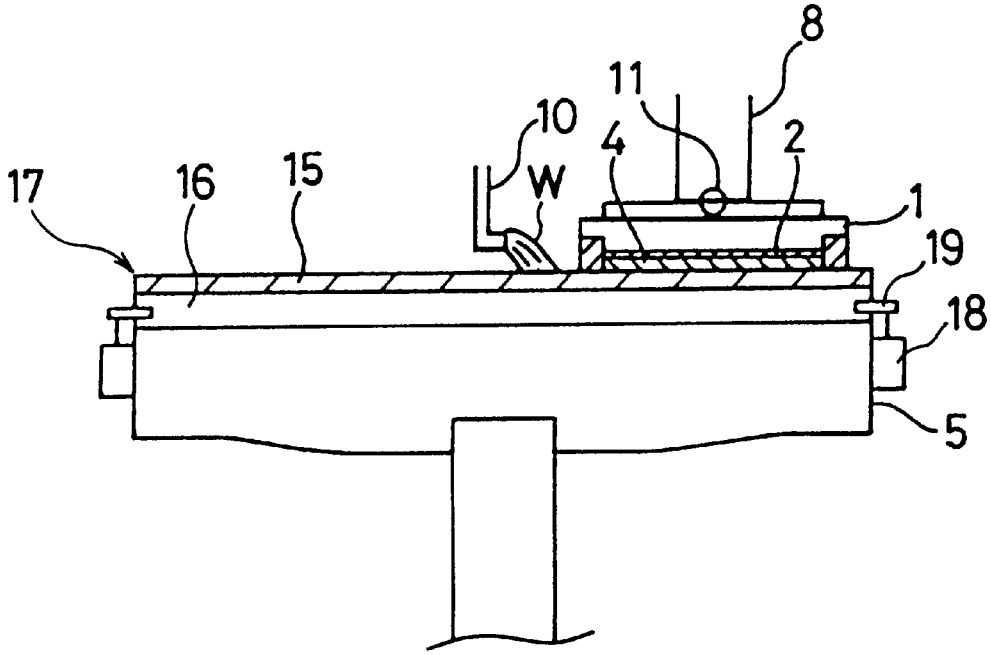
FIG. 2B is a vertical cross-sectional view of the polishing apparatus shown in FIG. 2A.

FIGS. 2A and 2B show a polishing apparatus according to the present invention. As shown in FIGS. 2A and 2B, the polishing apparatus comprises a turntable 5 supporting a grinding plate tool 17 thereon and a liquid supply nozzle 10 for supplying water or a chemical solution W to the grinding plate tool 17 during a polishing process. The grinding plate tool 17 comprises a grinding plate 15 having a diameter of about 60 cm bonded to a disk 16 of metal or ceramics by an adhesive. The grinding plate tool 17 is easily and reliably fixed to the turntable 5 by a clamp mechanism 18, 19.

Figure 1:
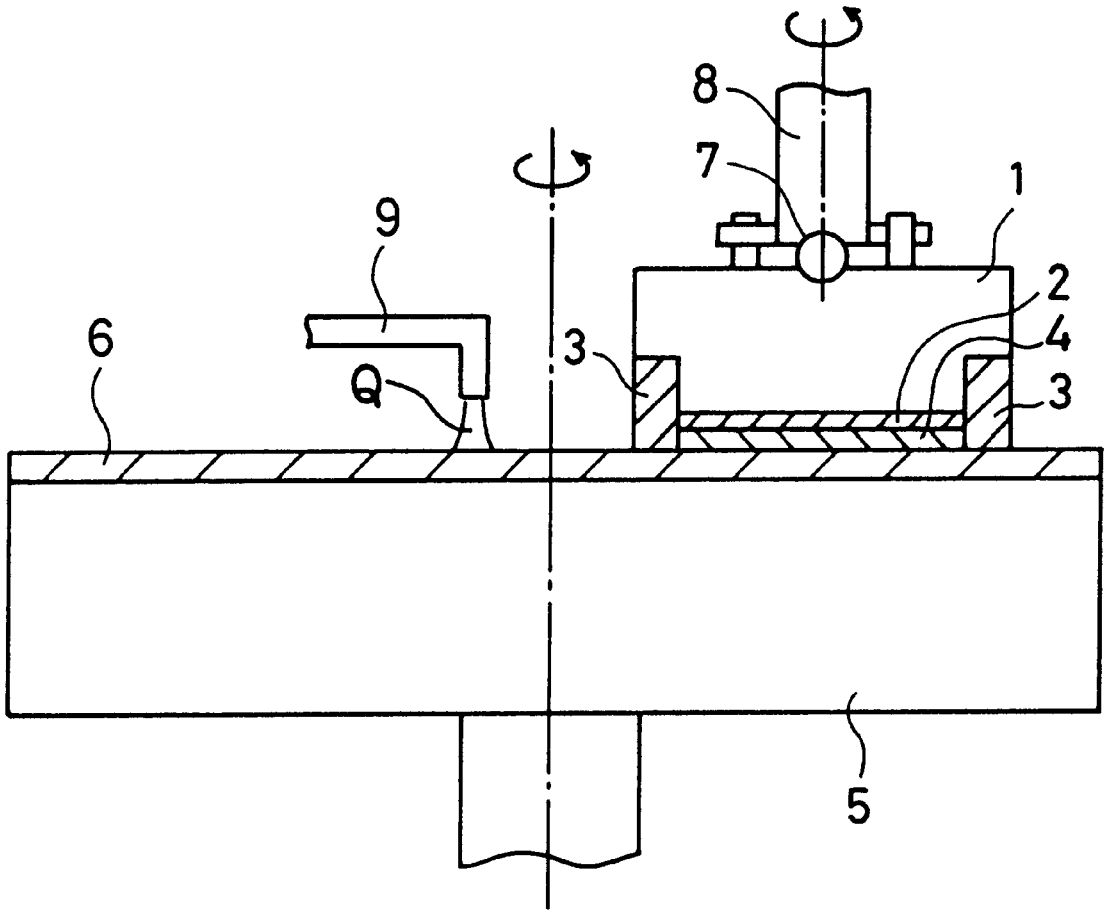
FIG. 1 is a vertical cross-sectional view of a conventional polishing apparatus.

The polishing apparatus also has a top ring 1 for supporting a planar workpiece such as a semiconductor wafer 4. The top ring 1 is tiltably supported on the lower end of a top ring drive shaft 8 by a ball bearing 11. The top ring 1 is basically of the same structure as the top ring of the conventional polishing apparatus as shown in FIG. 1.

The water or the chemical solution W is supplied to the grinding plate tool 7 in order to lubricate the surface of the semiconductor wafer 4 and dissipate the heat generated by the surface of the semiconductor wafer 4 when it is polished by the grinding plate tool 7. In the illustrated example, water is supplied at a rate of 200 ml/min. The water may comprise super pure water free of impurities, or may be replaced with an alkaline solution.

In operation, the semiconductor wafer 4 is held against a resilient mat 2 on the lower surface of the top ring 1 and pressed against the grinding plate 15, while at the same time the semiconductor wafer 4 is rotated with the top ring 1 by the top ring drive shaft 8. The turntable 5 on which the grinding plate tool 17 is fixedly supported is also rotated independently of the top ring 1. The lower surface of the semiconductor wafer 4 is polished by the grinding plate 15 which is held in sliding contact therewith.

The grinding plate 15 has a self-stopping function to stop polishing the semiconductor wafer 4 after the polished surface thereof has been planarized by the polishing process. The grinding plate 15 comprises fine abrasive grains of cerium oxide ($CeO_2$) having an average particle diameter of 2 $\mu$m or less and combined together by a binder of synthetic resin such as polyimide or the like. The grinding plate 15 may comprise fine abrasive grains of any of other materials including $SiO_2$, $Al_2O_3$, $ZrO_2$, $MnO_2$, $Mn_2O_3$ etc., and the fine abrasive grains may be connected together by any of other binders including phenolic resin, urethane resin, epoxy resin, polyvinyl alcohol, etc. These materials of the fine abrasive grains and the binders are to selected in view of the type of film to be formed on the polished semiconductor wafer 4 and the affinity between the abrasive grains and the binder.

The inventors of the present invention have found that a grinding plate has a good self-stopping function if it has a composition ratio in an appropriate range. Specifically, the abrasive grains of the grinding plate should be in the range from 10 to 60%. If the amount of abrasive grains exceeded 60%, then the grinding plate would tend to produce active or dislodged abrasive grains excessively, and produce an increased amount of acting abrasive grains, resulting in the elimination of the self-stopping function. Furthermore, the grinding wheel would be reduced in mechanical strength, i.e., it would tend to wear soon and collapse easily. In addition, when the grinding plate is produced, it would easily crack and could not easily be molded to shape. If the amount of abrasive grains were less than 10%, then since the amount of acting abrasive grains would be too small, the polishing rate would be too low, and the throughput of a semiconductor fabrication process would be reduced.

The amount of the binder should be in the range from 30 to 60%. If the amount of the binder were less than 30%, then it would fail to hold the abrasive grains under enough forces in the grinding plate structure, so that the grinding plate would tend to produce active or dislodged abrasive grains excessively, and produce an increased amount of acting abrasive grains, resulting in the elimination of the self-stopping function. Furthermore, the grinding plate would be reduced in mechanical strength, i.e., it would tend to wear soon and collapse easily. If the amount of the binder were in excess of 60%, then it would hold the abrasive grains under overly strong forces in the grinding plate structure, so that the grinding plate would not tend to produce active or dislodged abrasive grains, resulting in a large reduction in the polishing rate. In addition, the mechanical strength of the grinding plate would be so strong that it would damage the polished surface of the semiconductor wafer.

The grinding plate should have pores in the range from 10 to 40%. If the amount of the pores were less than 10% and if the binder were added in an excessively large amount, the binder would hold the abrasive grains under overly strong forces in the grinding plate structure, so that the grinding plate would not tend to produce active or dislodged abrasive grains, resulting in a large reduction in the polishing rate. If the amount of the abrasive grains were too large compared with the amount of the binder, then the grinding plate would tend to produce active or dislodged abrasive grains excessively, and the self-stopping function would be lost. If the amount of the pores were in excess of 40%, then the grinding plate would be reduced in mechanical strength, become brittle, and tend to wear and collapse soon. Furthermore, since the grinding plate would tend to produce active or dislodged abrasive grains excessively, and the self-stopping function would be lost.

The grinding plate may be of such a structure that it has pockets or independent pores that are several tens or several hundreds times greater than the abrasive grains. Those pockets will hold excessively produced active or dislodged abrasive grains and stably supply abrasive grains to the interface between the semiconductor wafer and the grinding plate. The pockets or independent pores can be generated by mixing abrasive grains, a binder, and a pore generating agent of a water-soluble polymer such as protein in a granular or fine powdery form, and molding, baking, and washing the mixture with water.

When the grinding plate of the above structure is used to polish a semiconductor wafer, it is not necessary to employ the expensive abrasive slurry of fine abrasive grain particles. Therefore, the cost of the polishing process is reduced. Moreover, any waste liquid from the polishing process can easily be processed without the need for special care to avoid environmental contamination. The cost of the polishing process is further reduced because no expendable polishing pads do not need to be used.

Specific embodiments of mechanisms for fixing the grinding plate tool to the turntable will be described below.

Figure 3:
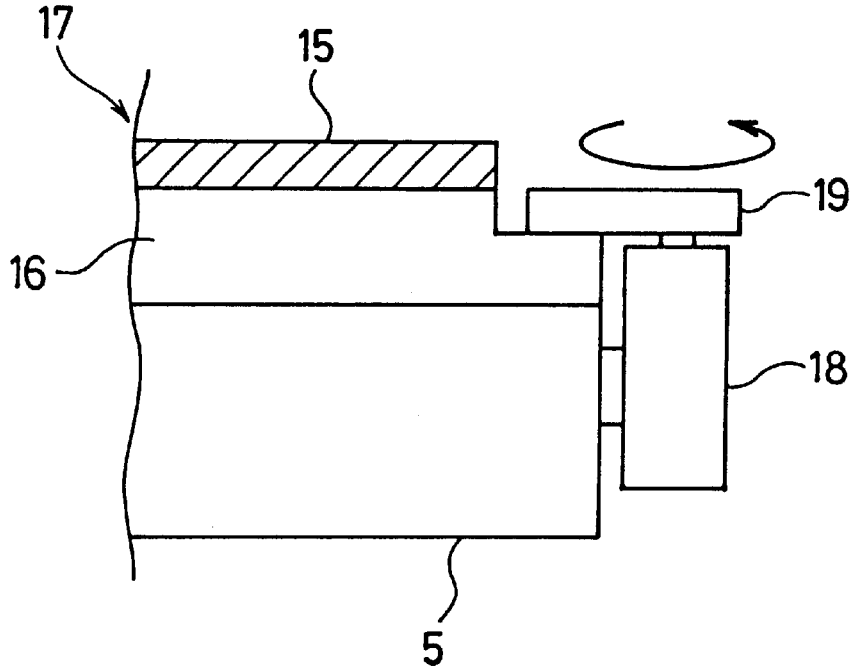
FIG. 3 is a fragmentary vertical cross-sectional view of a mechanism for clamping a grinding plate tool to a turntable.

FIG. 3 shows a mechanism for clamping the grinding plate tool 17 to the turntable 5. The grinding plate tool 17 comprises a grinding plate 15 bonded to a metal disk 16 of aluminum or the like. The turntable 5 has a clamp mechanism 18 mounted on an outer circumferential surface thereof and has a movable arm 19 for clamping an outer flange of the metal disk 16. When the movable arm 19 is turned to an open position away from the grinding plate tool 17, the grinding plate tool 17 is placed on the turntable 5. Then, the movable arm 19 is turned to a closed position on the grinding plate tool 17, and secures the grinding plate tool 17 to the turntable 5 with a spring mechanism (not shown) incorporated in the movable arm 19. The grinding plate tool 17 can be detached from the turntable 5 when the movable arm 19 is turned from the closed position to the open position.

Figure 4:
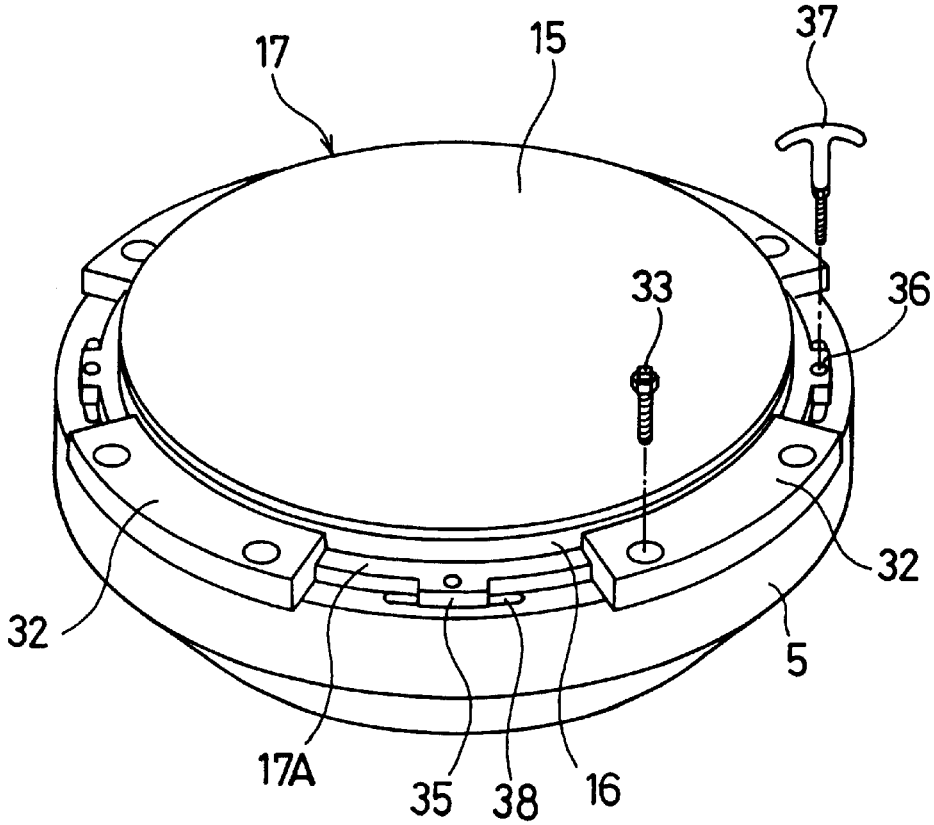
FIG. 4 is a fragmentary vertical cross-sectional view of another mechanism for clamping a grinding plate tool to a turntable.

FIG. 4 shows another mechanism for clamping the grinding plate tool 17 to the turntable 5. The grinding plate tool 17 comprises a grinding plate 15 bonded to a metal disk 16 of aluminum or the like which has an outer flange 17A. The flange 17A is fixed to the turntable 5 by clamps 32 that are fastened to the turntable 5 by bolts 33. Specifically, four clamps 32 are fastened to the turntable 5 by bolts 33 that are threaded into holes in the turntable 5 to thereby clamp the outer flange 17A to the turntable 5. Each of the clamps 32 comprises a relatively long arcuate member which subtends 44° at the center of curvature thereof, and is fastened by two bolts 33 to sandwich the outer flange 17A between itself and the upper surface of the turntable 5. Therefore, the grinding plate tool 17 can easily be fastened to and removed from the turntable 5 by tightening and loosening the bolts 33. The relatively long clamps 32 are employed to stably secure the outer flange 17A to the turntable 5 for thereby preventing the grinding plate 15 from flexing due to being pressed against the polished surface of the semiconductor wafer.

It is preferable that the clamps 32 press at least 40% of the entire outer circumferential length of the grinding plate tool 17 for distributing the pressure relatively uniformly over the outer circumferential surface of the grinding plate tool 17. If the outer circumferential length of the grinding plate tool 17 is divided by an integral number into three or four equal segments, then three or four clamps 32 may be placed on those three or four equal segments in rotational symmetry with respect to the center of the grinding plate tool 17. The clamps 32 thus positioned are effective to distribute the pressure relatively uniformly and can easily be installed and detached.

In FIG. 4, the flange 17A has four teeth 35 projecting radially outwardly from an outer circumferential edge thereof and angularly spaced at equal angular intervals. The teeth 35 have respective screw holes 36 in which lifting or pushing bolts 37 can be threaded. When the lifting bolts 37 are threaded into the screw holes 36, the lifting bolts 37 can be used to lift the grinding plate tool 17 off the turntable 5 for replacement. Since the grinding plate tool 17 is considerably heavy, the lifting bolts 37 allow the worker to handle the grinding plate tool 17 easily. When the pushing bolts 37 are threaded into the screw holes 36, the lifting bolts 37 can be used to assist in peeling the grinding plate tool 17 off the turntable, 5 for removal. Specifically, when the pushing bolts 37 are threaded into the screw holes 36 and continuously turned after their tip ends abut against the surface of the turntable 5, the pushing bolts 37 automatically lift-the grinding plate tool 17 off the turntable 17. The turntable 5 has arcuate grooves 38 defined in its upper outer circumferential surface below the respective teeth 35 for receiving the tip ends of the bolts 37 therein.

In the embodiment shown in FIG. 4, there are four clamps 32 and four teeth 35. Preferably, an annular clamp can be used to clamp the entire outer flange 17A of the grinding plate tool 17 to apply a uniform pressure to the outer flange 17A for thereby more stably holding the grinding plate 15 on the turntable 5. The number of teeth 35 may be increased or reduced in view of the weight of the grinding plate tool 17 or the desired level of intimate contact between the grinding plate tool 17 and the turntable 5. The metal disk 16 to which the grinding plate 15 is bonded may be made of stainless steel, titanium, or the like, or may be replaced with a disk of synthetic resin to provide greater resistance to corrosion.

Figure 5A:
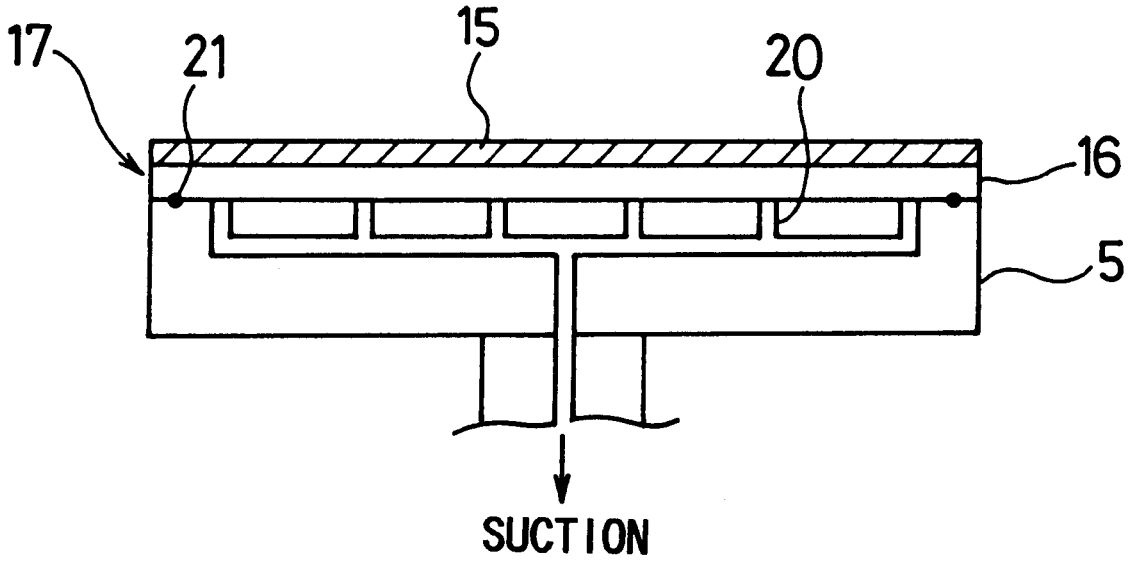
FIG. 5A is a vertical cross-sectional view of a mechanism for fixing a grinding plate tool to a turntable under vacuum.

FIG. 5A shows a mechanism for fixing the grinding plate tool 17 to the turntable 5 under vacuum suction. In FIG. 5A, the turntable 5 has a plurality of interconnected holes 20 defined therein for drawing air from between the grinding plate tool 17 and the turntable 5 to attract the grinding plate tool 17 to the turntable 5 under a vacuum suction developed by a vacuum pump or the like. An O-ring 21 is interposed between the turntable 5 and the grinding plate tool 17 to provide a seal therebetween. When the interconnected holes 20 are evacuated by the vacuum pump or the like, attractive forces act on the grinding plate tool 17 to secure the grinding plate tool 17 to the turntable 5.

Figure 5B:
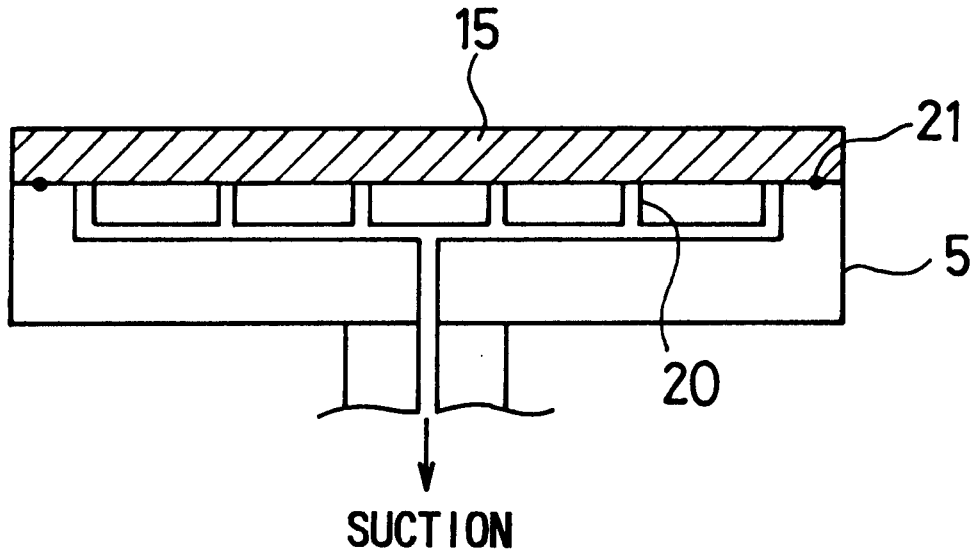
FIG. 5B is a vertical cross-sectional view of a mechanism for fixing a grinding plate directly to a turntable under vacuum.

FIG. 5B shows a mechanism for fixing the grinding plate 15 directly to the turntable 5 under vacuum suction. In FIG. 5B, the grinding plate 15 is free of any supporting metal disk, and is directly attracted to the turntable 5 by a vacuum suction developed in the interconnected holes 20 and hence between the grinding plate 15 and the turntable 5.

Figure 6A:
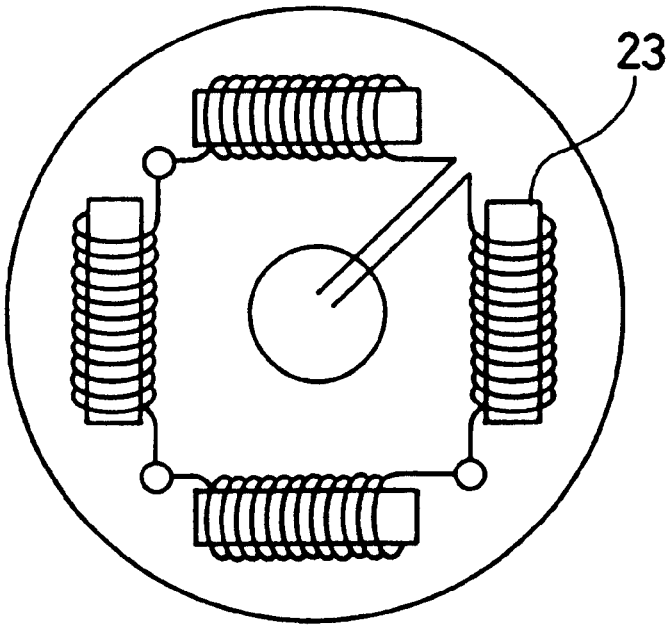
FIG. 6A is a plan view of a mechanism for fixing a grinding plate tool to a turntable with electromagnets.
Figure 6B:
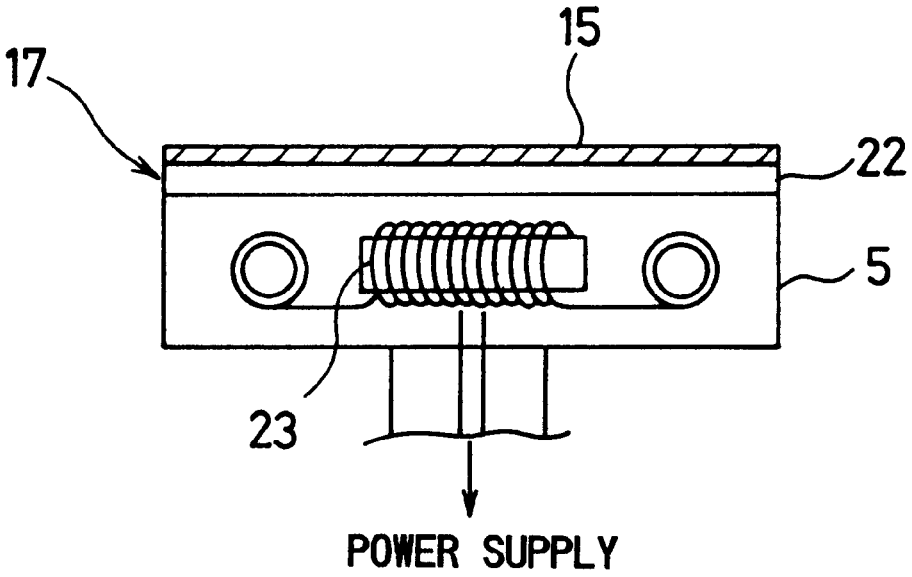
FIG. 6B is a side elevational view of the mechanism shown in FIG. 6A.

FIGS. 6A and 6B show a mechanism for fixing the grinding plate tool 17 to the turntable 5 with electromagnets. The turntable 5 houses therein a plurality of electromagnets 23. The grinding plate tool 17 comprises a disk 22 supporting the grinding plate 5 bonded thereto, the disk 22 being made of a magnetic material such as pure iron. When the grinding plate tool 17 is placed on the turntable 5 and an electric current is supplied to the coils of the electromagnets 23, the electromagnets 23 generate magnetic attractive forces to attract and fix the disk 22 to the turntable 5. When the electric current is supplied to the coils of the electromagnets 23 is cut off, the electromagnets 23 generate no magnetic attractive forces, allowing the grinding plate tool 17 to be easily removed from the turntable 5.

Figure 7A:
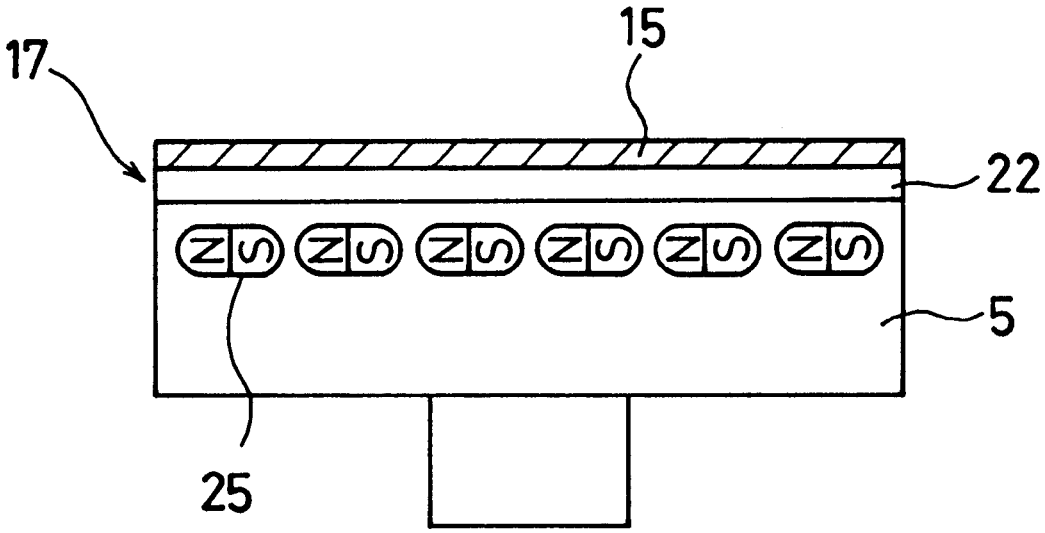
FIGS. 7A and 7B are vertical cross-sectional views of a mechanism for fixing a grinding plate tool to a turntable with an array of permanent magnets, FIG. 7A showing the permanent magnets as being horizontally oriented and FIG. 7B showing the permanent magnets as being vertically oriented.
Figure 7B:
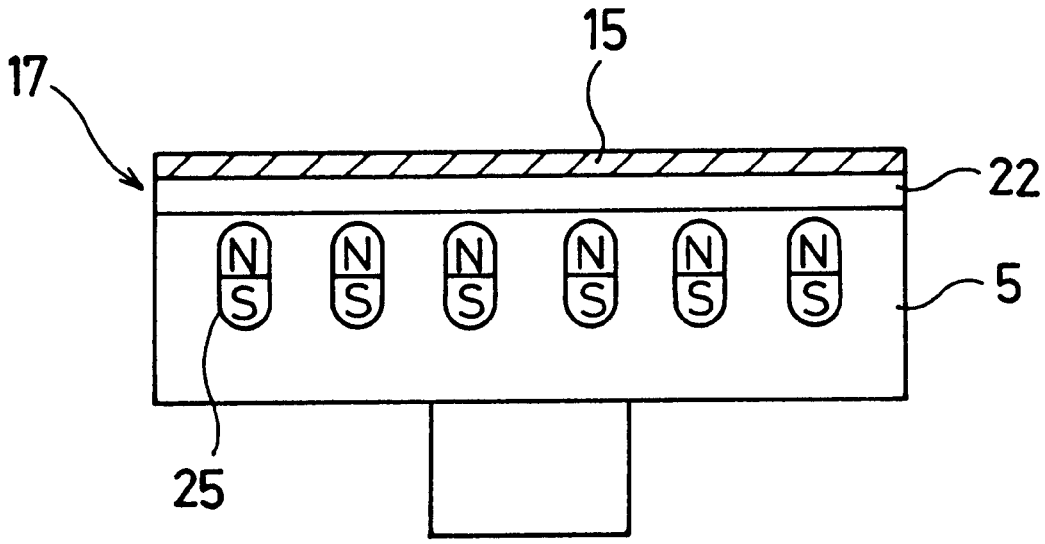

FIGS. 7A and 7B show a mechanism for fixing the grinding plate tool 17 to the turntable 5 with an array of permanent magnets 25. The grinding plate tool 17 comprises a disk 22 supporting the grinding plate 5 bonded thereto, the disk 22 being made of a magnetic material such as pure iron. The permanent magnets 25 are housed in the turntable 5 and can be angularly moved between a horizontally oriented position and a vertically oriented position by a mechanism that can be operated from outside of the turntable 5. FIG. 7A shows the permanent magnets 25 as being horizontally oriented, and FIG. 7B shows the permanent magnets 25 as being vertically oriented. When the permanent magnets 25 are horizontally oriented, as shown in FIG. 7A, magnetic forces applied from the permanent magnets 25 to the upper surface of the turntable 5 are relatively weak, allowing the grinding plate tool 17 to be freely installed on and detached from the turntable 5. When the permanent magnets 25 are vertically oriented, as shown in FIG. 7B, magnetic forces applied from the permanent magnets 25 to the upper surface of the turntable 5 are relatively strong, magnetically attracting the grinding plate tool 17 to the turntable 5.

Figure 8A:
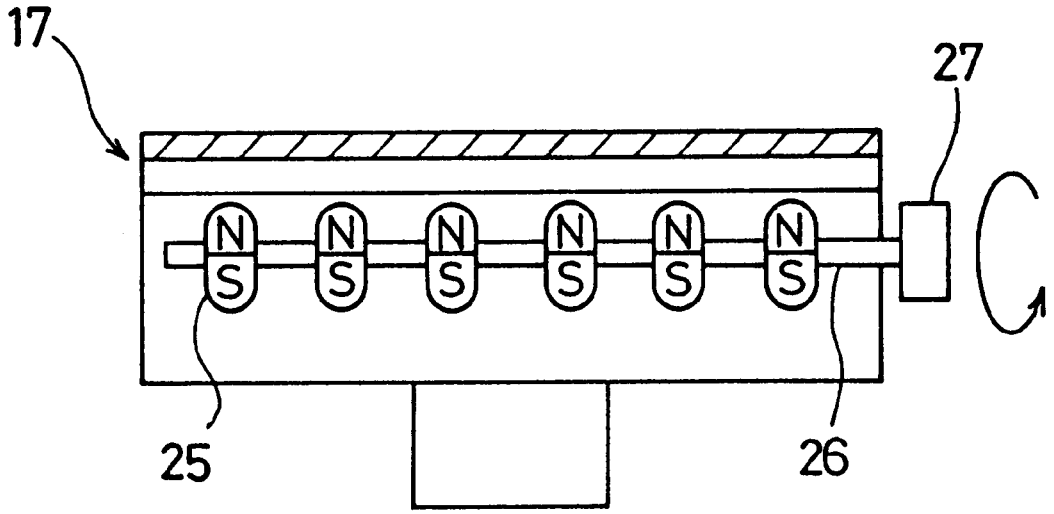
FIG. 8A is a vertical cross-sectional view of a mechanism for fixing a grinding plate tool to a turntable with permanent magnets that can be rotated by a manual handle.

FIG. 8A shows a mechanism for fixing the grinding plate tool 17 to the turntable 5 with the permanent magnets 25 that can be rotated by a manual handle 27. The grinding plate tool 17, the turntable 5, and the permanent magnets 25 shown in FIG. 8A are identical to those shown in FIGS. 7A and 7B. The permanent magnets 25 are mounted on a horizontal rotatable shaft 26 extending in the turntable 5 and having an end projecting out of the turntable 5. The manual handle 27 is fixed to the projecting end of the rotatable shaft 26. When the manual handle 27 is manually turned, the permanent magnets 25 can be angularly moved between the horizontally oriented position and the vertically oriented position. In the horizontally oriented position, the permanent magnets 25 allow the grinding plate tool 17 to be freely installed on and detached from the turntable 5. In the vertically oriented position (see FIG. 8A), the permanent magnets 25 magnetically attract the grinding plate tool 17 to the turntable 5.

Figure 8B:
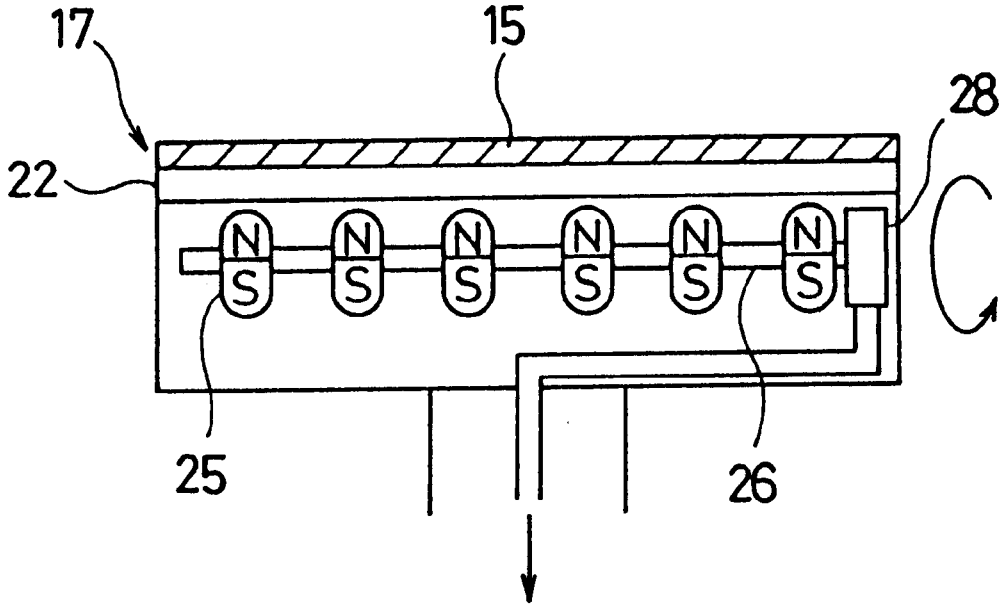
FIG. 8B is a vertical cross-sectional view of a mechanism for fixing a grinding plate tool to a turntable with permanent magnets that can be rotated by a switch mechanism.

FIG. 8B shows a mechanism for fixing the grinding plate tool 17 to the turntable 5 with the permanent magnets 25 that can be rotated by a switch mechanism 28. The grinding plate tool 17, the turntable 5, and the permanent magnets 25 shown in FIG. 8B are identical to those shown in FIGS. 7A and 7B. The permanent magnets 25 are mounted on a horizontal rotatable shaft 26 extending in the turntable 5 and having an end connected to the switch mechanism 28 disposed in the turntable 5. The switch mechanism 28 comprises a motor, for example, which, when energized by a rotation signal supplied from an external control circuit, is energized to rotate the shaft 26 to turn the permanent magnets 25 between the horizontally oriented position and the vertically oriented position. In the horizontally oriented position, the permanent magnets 25 allow the grinding plate tool 17 to be freely installed on and detached from the turntable 5. In the vertically oriented position (see FIG. 8B), the permanent magnets 25 magnetically attract the grinding plate tool 17 to the turntable 5.

Figure 9A:
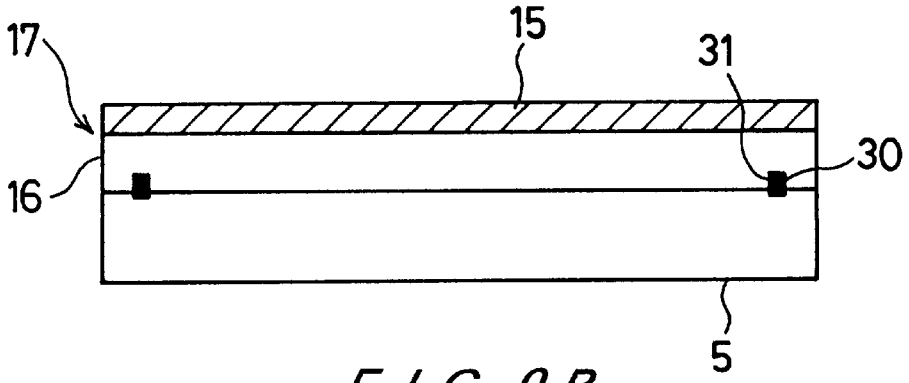
FIG. 9A is a vertical cross-sectional view of a mechanism for fixing a grinding plate tool to a turntable with stopper pins.
Figure 9B:
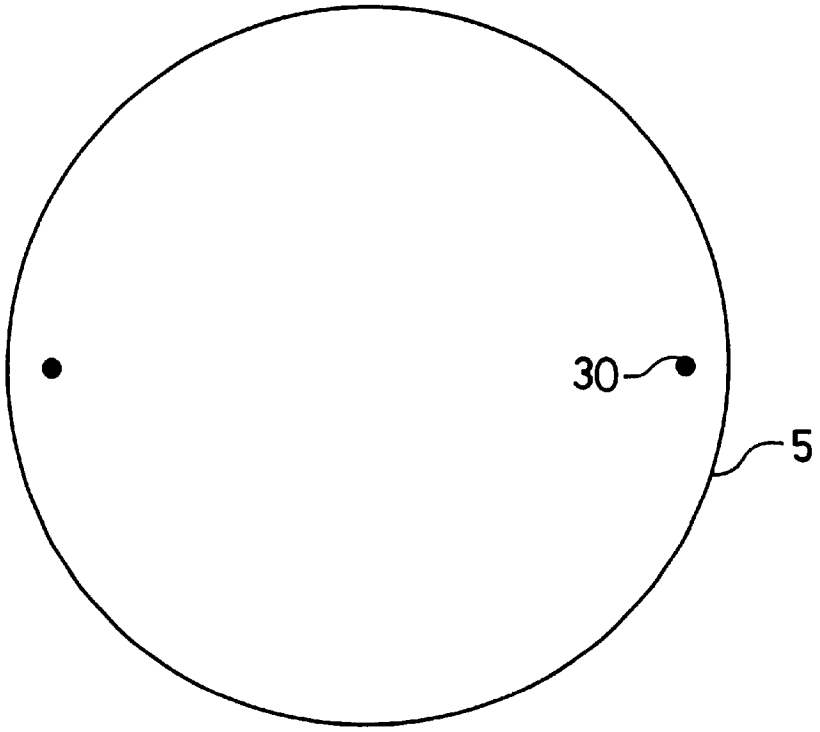
FIG. 9B is a plan view of the mechanism shown in FIG. 9A.
Figure 9C:
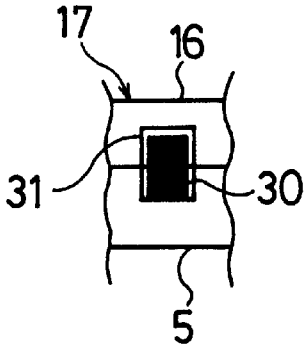
FIG. 9C is an enlarged view showing the manner in which a stopper pin is fitted in a recess.

FIGS. 9A, 9B, and 9C show a mechanism for fixing grinding plate tool 17 to the turntable 5 with stopper pins 30. The stopper pins 30 are vertically mounted on an upper surface of the turntable 5, and the metal disk 16 of the grinding plate tool 17 has recesses 31 defined in a lower surface thereof for receiving the respective stopper pins 30. When the stopper pins 30 are fitted in the respective recesses 31, as shown in FIG. 9C, the grinding plate tool 17 is fixed to the turntable 5. In the polishing process, the grinding plate tool 17 is prevented from being displaced relatively to the turntable 5, and remains reliably fixed to the turntable 5 by the stopper pins 30. To remove the grinding plate tool 17, it is simply lifted off the turntable 5. To install the grinding plate tool 17, it is dropped onto the turntable 5 with the stopper pins 30 being kept in alignment with the respective recesses 31. Accordingly, the grinding plate tool 17 can easily be installed on and removed from the turntable 5.

Figure 10A:
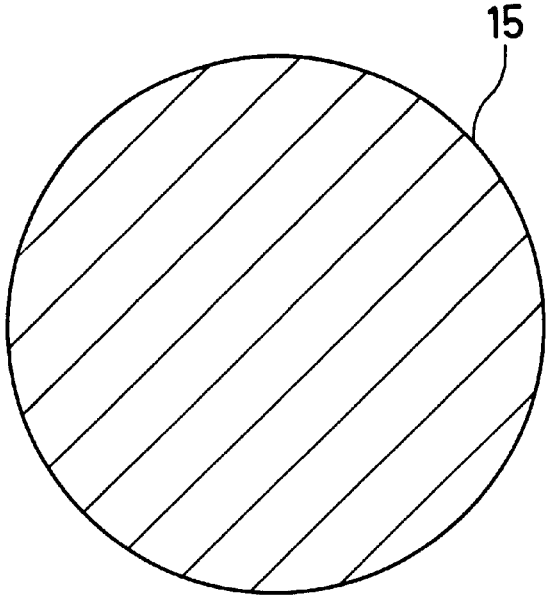
FIG. 10A is a plan view of an ordinary grinding plate.
Figure 10B:
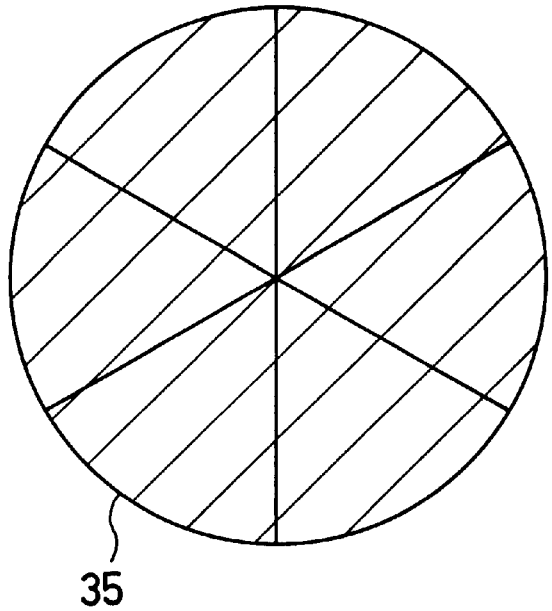
FIG. 10B is a plan view of a grinding plate which is divided into segments.

FIGS. 10A and 10B show the manner in which the grinding plate 15 is divided into segments 35. As semiconductor wafers to be polished have a larger diameter, they have a greater weight, and hence cannot efficiently be installed on and detached from the turntable and cannot efficiently be handled or transported. The grinding plate 15 of ordinary shape shown in FIG. 10A may be divided into a plurality of grinding plate segments 35 shown in FIG. 10B. If the grinding plate segments 35 are fixed to the turntable 5 by the clamps 18 (see FIG. 3) or the clamps 32 (see FIG. 4), then only the outer circumferential edges thereof are fixed. Therefore, the ends of the grinding plate segments 35 at the center of the turntable 5 may also be fastened to the turntable 5 by screws or the like for greater stability. If the grinding plate segments 35 are fixed to the turntable 5 by the other mechanisms shown in FIGS. 5A, 5B through 10A, 10B, then the grinding plate segments 35 can be secured in place in the same manner as the grinding plate 15 of ordinary shape shown in FIG. 10A.

Polishing apparatus which employ the grinding plate for polishing planar workpieces to a flat, mirror finish including a scroll-type polishing apparatus and a cup-type polishing apparatus.

The scroll-type polishing apparatus has a grinding plate fixedly mounted on a table, and a holder for holding a planar workpiece to be polished. The grinding plate and the planar workpiece held by the holder are held against each other and relatively moved in sliding contact in a circular path to polish the planar workpiece. The cup-type polishing apparatus has a cup-shaped grinding plate fixedly supported by a support, and a table for supporting a planar workpiece to be polished. The cup-shaped grinding plate is held against the planar workpiece supported on the table and moved in sliding contact with the planar workpiece to polish the planar workpiece. The principles of the present invention are also applicable to the scroll-type polishing apparatus and the cup-type polishing apparatus.

Although certain preferred embodiments of the present invention have been shown and described in detail, it should be understood that various changes and modifications may be made therein without departing from the scope of the appended claims.

What is claimed is:

1. A polishing apparatus comprising:

a table;

a polishing tool comprising a polishing surface fixed with respect to a disk, said polishing tool having an outer peripheral portion; and a plurality of clamps for fastening said polishing tool to said table by sandwiching said outer peripheral portion of said polishing tool between said clamps and said table, wherein each of said clamps has an arcuate shape that corresponds to the shape of said outer peripheral portion.

2. The polishing apparatus of claim 1, wherein said clamps fasten said polishing tool to said table at least three circumferentially spaced points on said outer periphery of said polishing tool.

3. The polishing apparatus of claim 1, wherein each of said clamps are fastened to said table by a plurality of bolts.

4. The polishing apparatus of claim 1, wherein said clamps are spaced about said outer periphery of said polishing tool at equal intervals.

5. The polishing apparatus of claim 1, wherein said polishing tool comprises a grinding plate forming said polishing surface.

6. The polishing apparatus of claim 1, wherein said polishing tool comprises abrasive grains and a binder forming said polishing surface.

7. A polishing apparatus comprising:

a table, a polishing tool comprising a polishing surface fixed with respect to a disk, said polishing tool having an outer peripheral portion; and a clamp for fastening said polishing tool to said table by sandwiching said outer peripheral portion of said polishing tool between said clamp and said table, wherein at least 40% of the entire circumferential extent of said outer peripheral portion of said polishing tool is fastened by said clamp.

* * * * *